US010299586B1

(12) United States Patent
Powwarynn

(10) Patent No.: US 10,299,586 B1
(45) Date of Patent: May 28, 2019

(54) SNAP FIT DRAWER SLIDE SYSTEM

(71) Applicant: Thomas Powwarynn, Los Angeles, CA (US)

(72) Inventor: Thomas Powwarynn, Los Angeles, CA (US)

( * ) Notice: Subject to any disclaimer, the term of this patent is extended or adjusted under 35 U.S.C. 154(b) by 0 days.

(21) Appl. No.: 15/726,699

(22) Filed: Oct. 6, 2017

(51) Int. Cl.
*A47B 88/423* (2017.01)
*A47B 88/407* (2017.01)
*A47B 88/417* (2017.01)
*A47B 57/00* (2006.01)

(52) U.S. Cl.
CPC ..... *A47B 88/423* (2017.01); *A47B 57/00* (2013.01); *A47B 88/407* (2017.01); *A47B 88/417* (2017.01); *A47B 2088/4235* (2017.01)

(58) Field of Classification Search
CPC ..... A47B 88/423; A47B 88/407; A47B 57/00; A47B 2088/4235; A47B 88/43; A47B 88/931; A47B 88/938
USPC ..... 312/348.1, 349–350; 248/213.2, 644, 248/200.1
See application file for complete search history.

(56) References Cited

U.S. PATENT DOCUMENTS 4,118,087 A * 10/1978 Dorf ..... A47B 45/00 211/105.6
6,443,544 B1 * 9/2002 Wolf ..... A47B 88/90 312/263
6,655,538 B2 * 12/2003 Saulnier-Matteini ..... A47B 45/00 211/105.1
2012/0217858 A1 * 8/2012 Lai ..... A47B 17/00 312/334.5
2017/0086584 A1 * 3/2017 Rehage ..... F25D 25/025

* cited by examiner

*Primary Examiner* — Christopher Garft
(74) *Attorney, Agent, or Firm* — Shifrin Patent Law; Dan Shifrin

(57) ABSTRACT

A snap fit drawer slide system allows sliding shelves, trays, and drawers to be easily installed inside a cabinet with existing pre-drilled shelf support pin holes. The device can also be easily removed after installation, and the user can easily adjust each sliding shelve to a desired height. For cabinets without shelf support pin holes, the system provides optional shelf standards with support pin holes. Pre-scored lines allow each shelf standard to be easily snapped to a desired length.

13 Claims, 12 Drawing Sheets

SNAP FIT DRAWER SLIDE SYSTEM

TECHNICAL FIELD

The present invention relates to shelf and drawer slides for cabinet access and organization with a special mechanism and improved method for installation.

BACKGROUND ART

The typical drawer slide system requires complicated installation for installing drawer slide hardware inside the cabinet. Due to the design of the conventional drawer slide system, adjustment after installation is complicated and may require several tools.

SUMMARY OF THE INVENTION

Embodiments of the present invention provide a snap fit drawer slide system to allow users to easily fit a sliding shelf into a cabinet with a shelf supporting pin system. The system comprises a pair of cross bars, a pair of drawer slides, a tray attachable to the drawer slides, a mounting mechanism for attaching the drawer slide to the cross bars, and an optional set of pre-scored shelf standards. Tension from the cross bars secures both ends of each cross bar into two opposite shelf supporting pin holes. The drawer slide hardware has a special mounting apparatus attached for easy installation on the cross bars.

DETAILED DESCRIPTION OF THE PREFERRED EMBODIMENT

The described features, structures, or characteristics of the invention may be combined in any suitable manner in one or more embodiments. In the following description, specific details are provided to provide a thorough understanding of embodiments of the invention. One skilled in the relevant art will recognize, however, that the invention can be practiced without one or more of the specific details, or with other methods, components, and so forth. In other instances, well-known structures, materials, or operations are not shown or described in detail to avoid obscuring aspects of the invention.

Figure 1A:
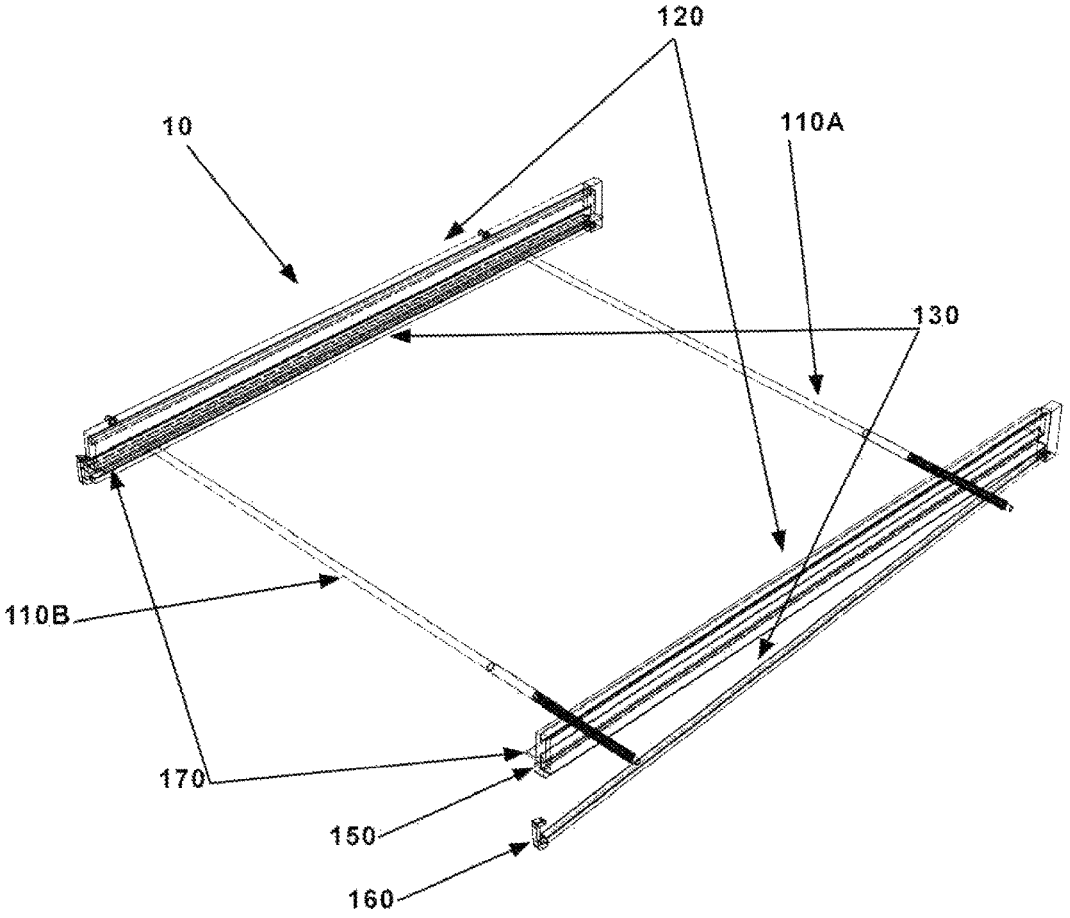
FIG. 1A is an isometric view an embodiment of the snap fit drawer slide system of the present invention.
Figure 3A:
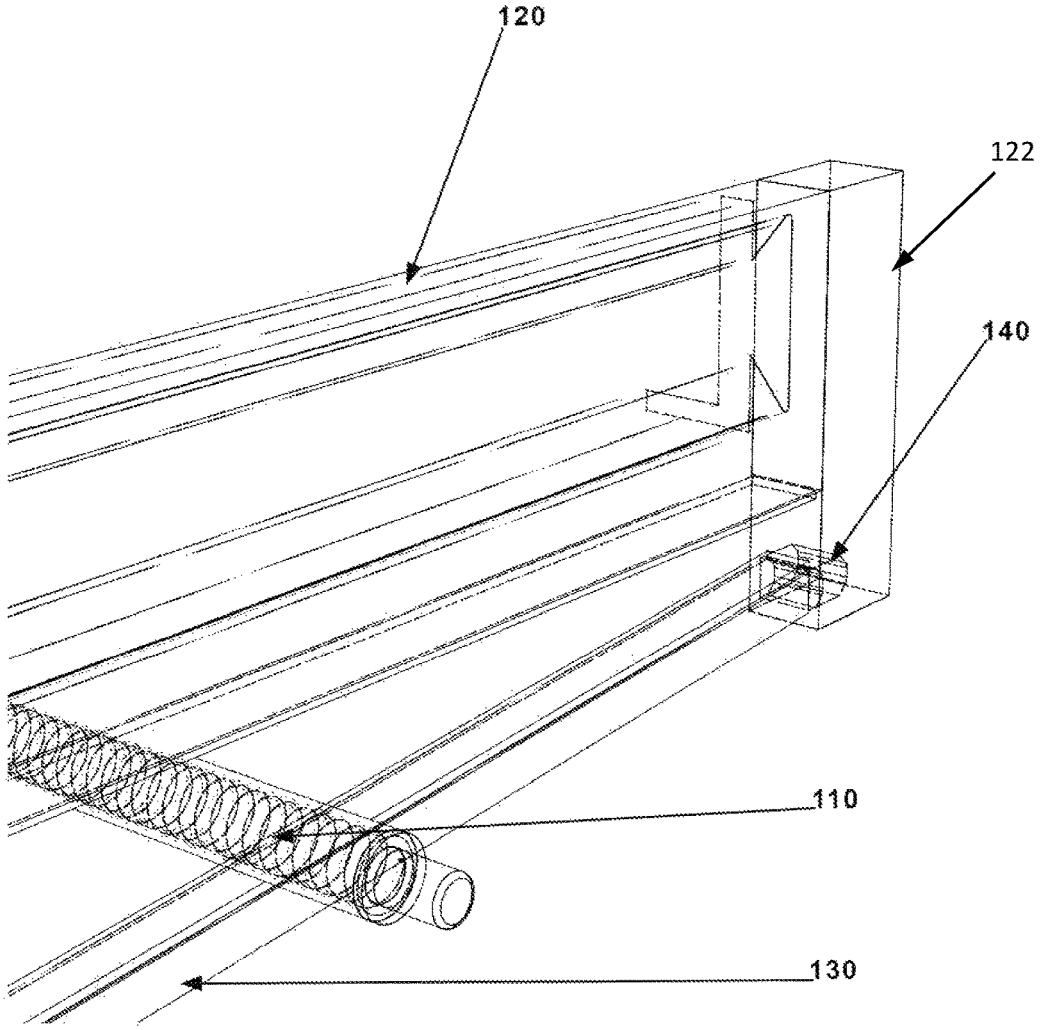
FIG. 3A is a close-up view of the back end of the drawer slide system of FIG. 1A.
Figure 3B:
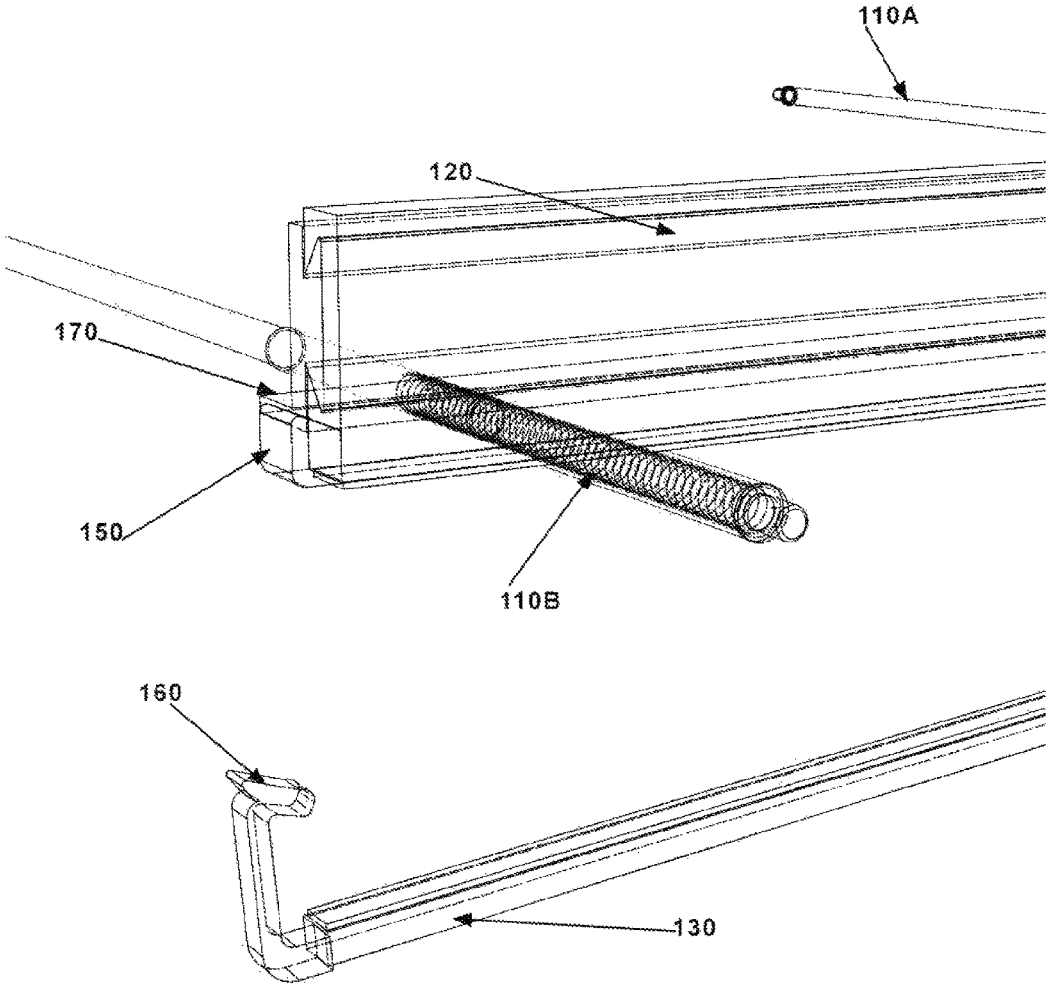
FIG. 3B is a close-up view of the front end of the drawer slide system of FIG. 1A.

Referring more particularly to the drawings, a representative embodiment of a snap fit drawer slide system 10 of the present invention is illustrated in FIG. 1A. The snap fit drawer slide system 10 includes a pair of cross bars 110A, 110B (collectively 110), a pair of drawer slides 120, each with a removable lower clamp jaw 130. The front section of each drawer slide 120 contains a strike 150 for hooking onto or receiving a latch 160 extending upward from the front section of the corresponding lower clamp jaw 130 (FIG. 3B). The lower clamp jaws 130 apply clamping pressure over the spring-loaded cross bars 110 after the latch 160 and strike 150 are connected. Extending inward from the bottom of each drawer slide 120 is a flange or drawer slide bracket 170. Extending downward from the rear of each drawer slide 120 is a support 122 (FIG. 3A) having a front facing lower slot 140.

Figure 1B:
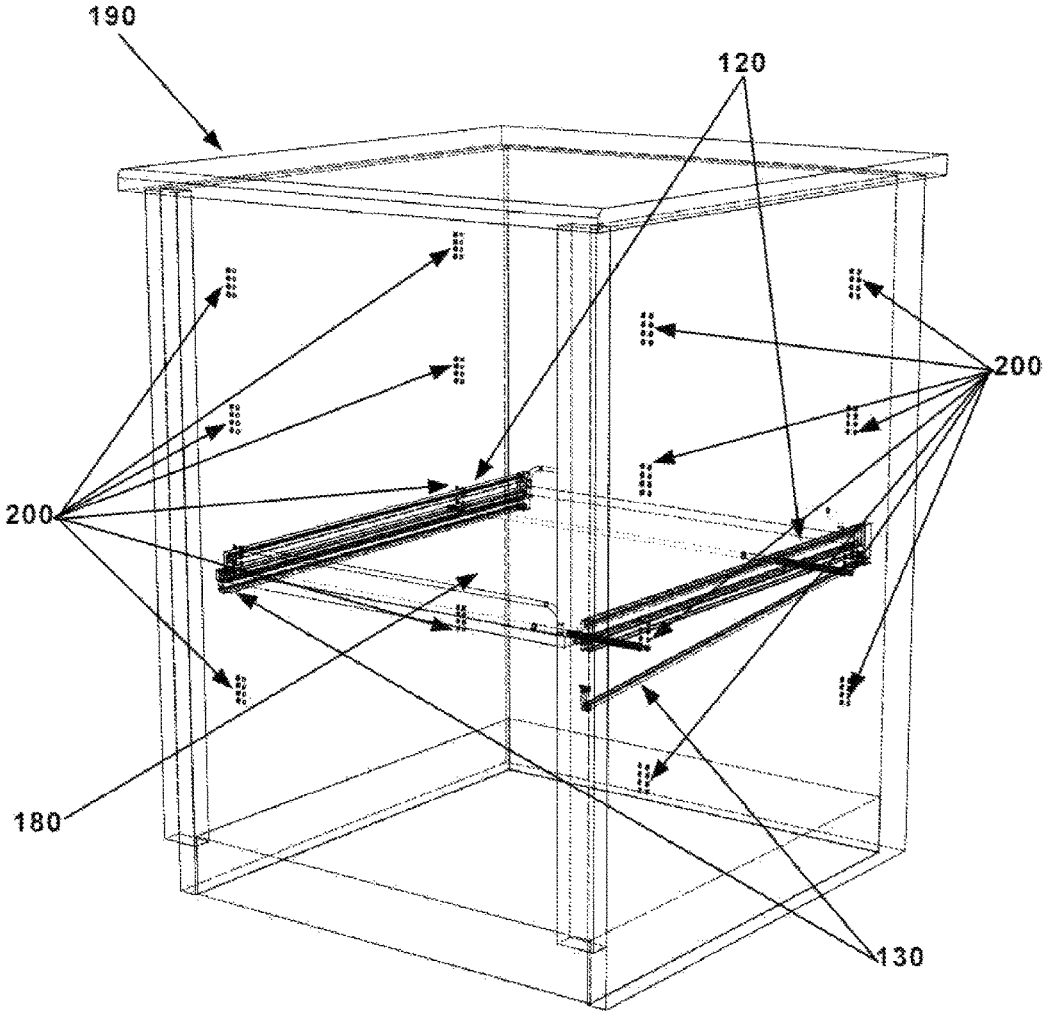
FIG. 1B is an isometric wire-frame view of the drawer slide system of FIG. 1A installed inside a cabinet.

FIG. 1B illustrates the snap fit drawer slide system 10 with a tray 180 or shelf installed inside a cabinet 190. The sides of the cabinet 190 have sets of pre-drilled holes 200 to accept shelf pins. In one embodiment, the cross bars 110 have two pieces, one sliding inside the other against a spring bias (see FIG. 3B). To install the system 10 inside a cabinet, one end of one of the spring-loaded cross bars 110A is inserted into a first pre-drilled hole 200 near the front of one side of the cabinet 190. The opposite end of the spring-loaded cross bar 110A is then compressed towards the first end so that it may be inserted into the pre-drilled hole 200 directly opposite the first hole 200 in the other side of the cabinet. The process is repeated to insert the ends of the other spring-loaded cross bar 110B into opposing pre-drilled holes 200 near the rear of the cabinet at the same height as the sets of holes 200 near the back. Instead of using a spring to generate tension in the cross bars 110, the two pieces of the cross bars 110 may be joined with threads enabling tension to be generated by turning the two pieces in opposite directions in an unscrewing motion. The two pieces of the cross bars 110 may be telescoping and joined using other mechanisms including, for example, a twist-and-lock internal mechanism similar to that used with camera tripods and trekking poles. The cross bars 110 may also each be a single rod cut to the width of the inside of the cabinet 190.

Figure 2A:
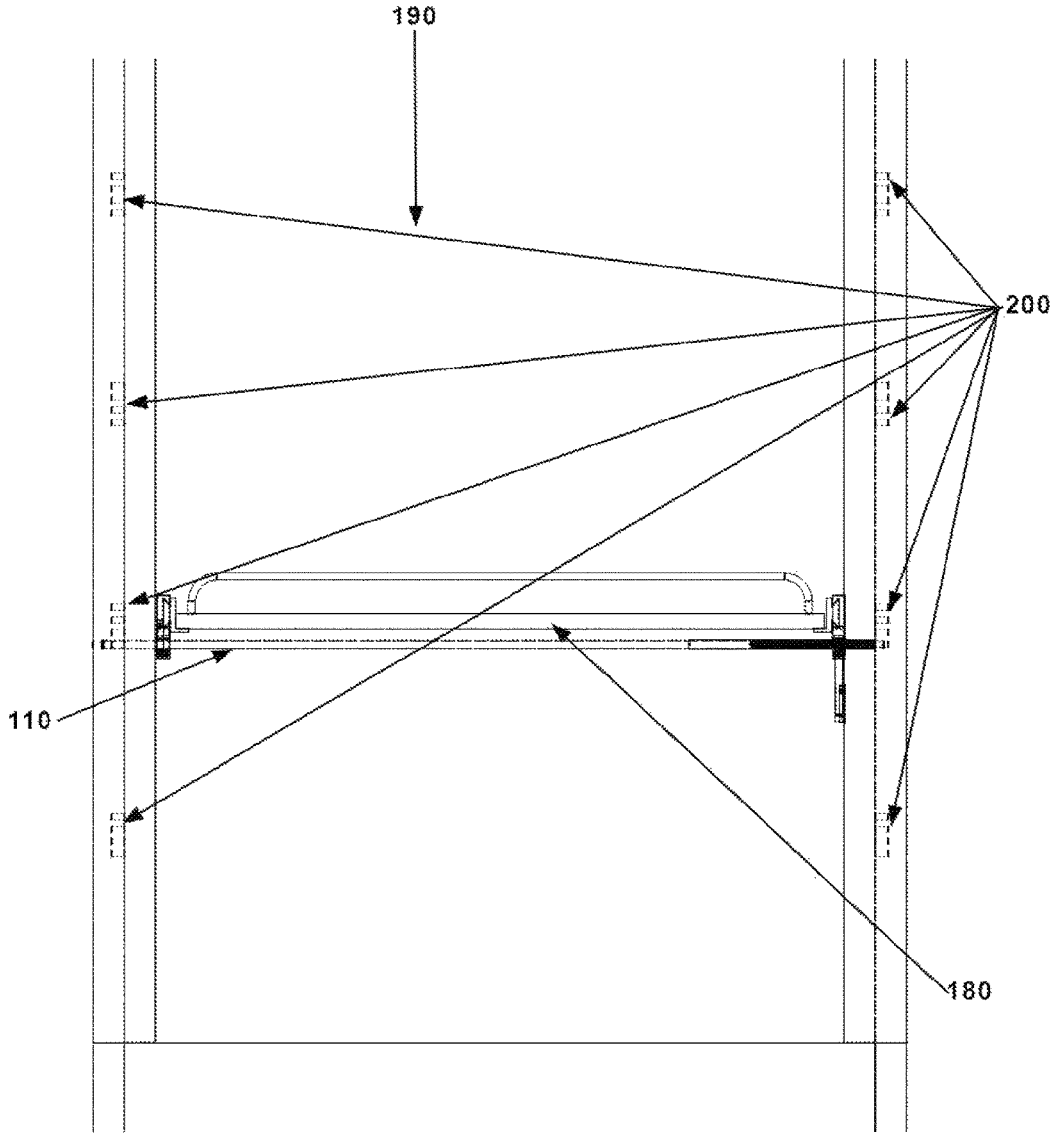
FIG. 2A is a front view of the installed drawer slide system of FIG. 1B.
Figure 2B:
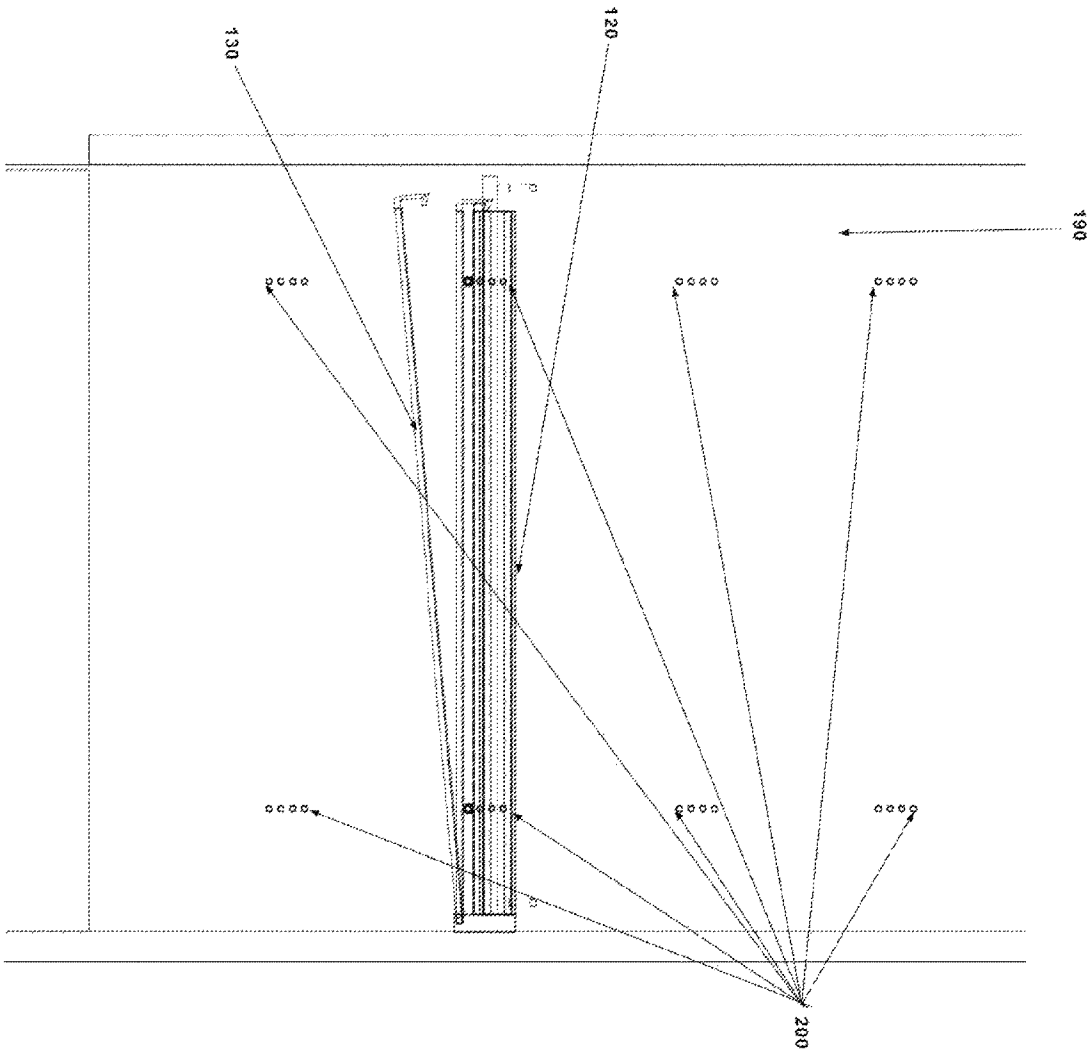
FIG. 2B is a side view of the installed drawer slide system of FIG. 1B.
Figure 4:
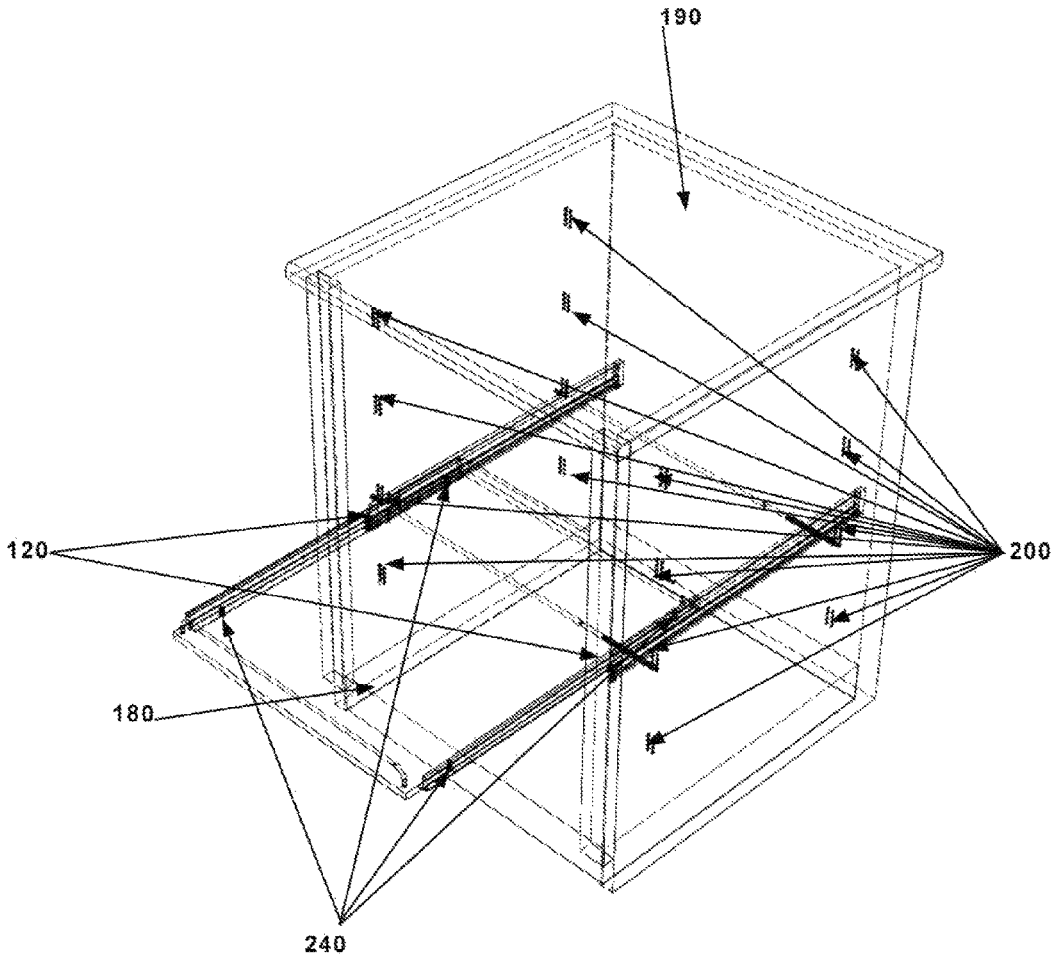
FIG. 4 is an isometric wire-frame view of the installed drawer slide system of FIG. 1B in its extended position.

Next, the flat tray 180 is attached to the left and right drawer slide brackets 170 of the tray with screws 240. With both cross bars 110 installed and the tray 180 attached to the slide brackets 170, the drawer slides 120 and tray 180 are centered onto the cross bars 110 (FIG. 2A) with front ends of drawer slides 120 facing the front opening of the cabinet 190. The tray 180 and drawer slides 120 are pushed backwards until the tray 180 is positioned slightly behind the front opening of the cabinet 190, as illustrated in the side view of FIG. 2B. After the tray 180 and drawer slides 120 are in place, the drawer slides 120 are secured to the left and right sides of the tray 180 using the removable lower clamp jaw 130. The back side of each lower clamp jaw 130 is inserted into the lower opening slot 140 in the support 122 extending from the back of the drawer slide 120 (FIG. 3A). The drawer slide 120 is clamped down onto the front and back cross bars 120A, 120B by hooking the latch 150 (FIG. 3B) to the strike 160 (FIG. 3B). After both of the drawer slides 120 are secured to the cross bars 110, the tray 180 and drawer slides 120 on both sides of the cabinet 190 can slide outward away from cabinet (FIG. 4).

Figure 3C:
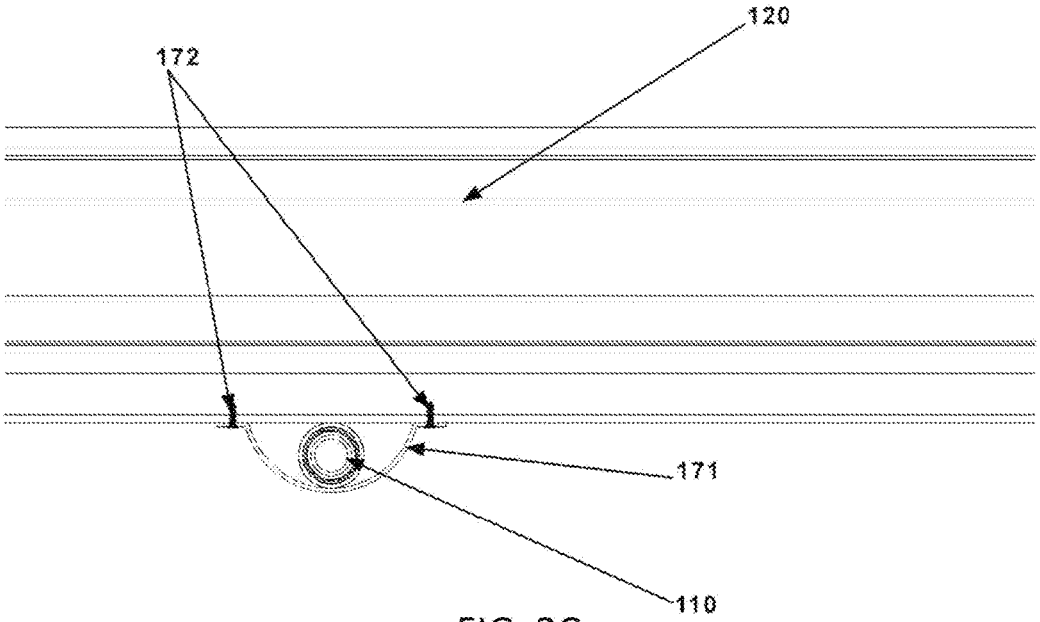
FIG. 3C is a side view of a drawer slide with a securing bracket.
Figure 3D:
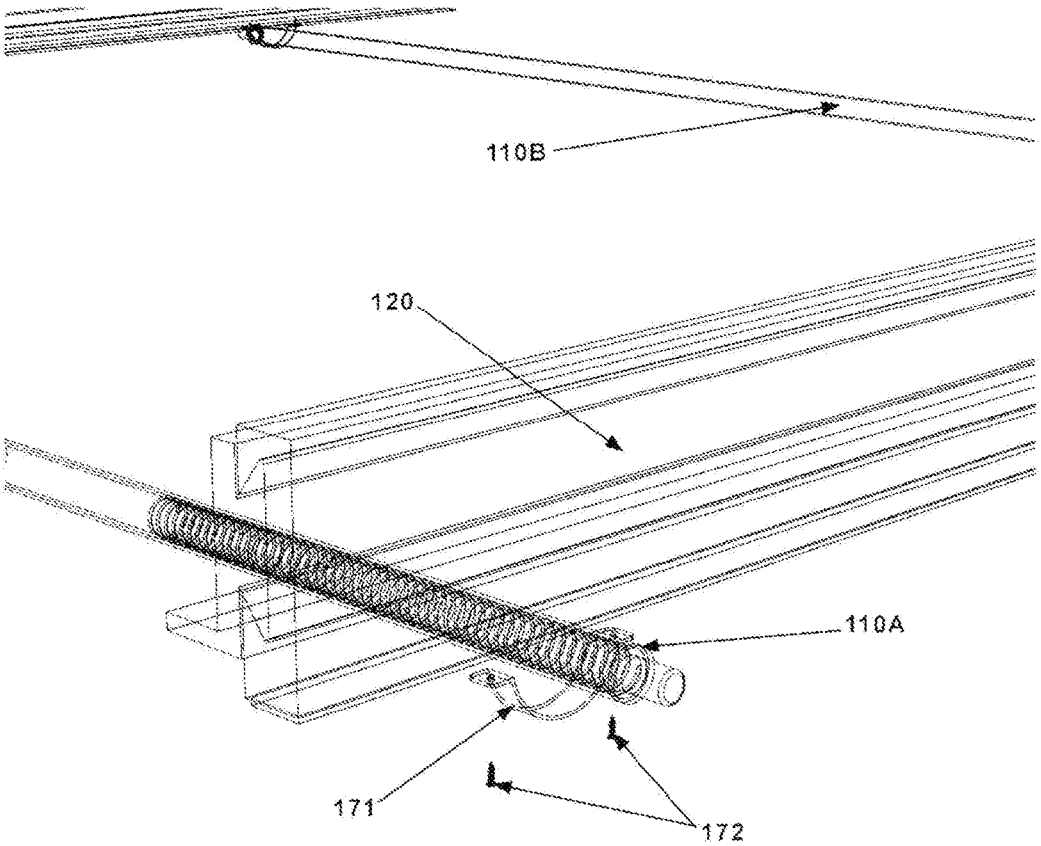
FIG. 3D is an exploded perspective view of the drawer slide and bracket of FIG. 3C.
Figure 3E:
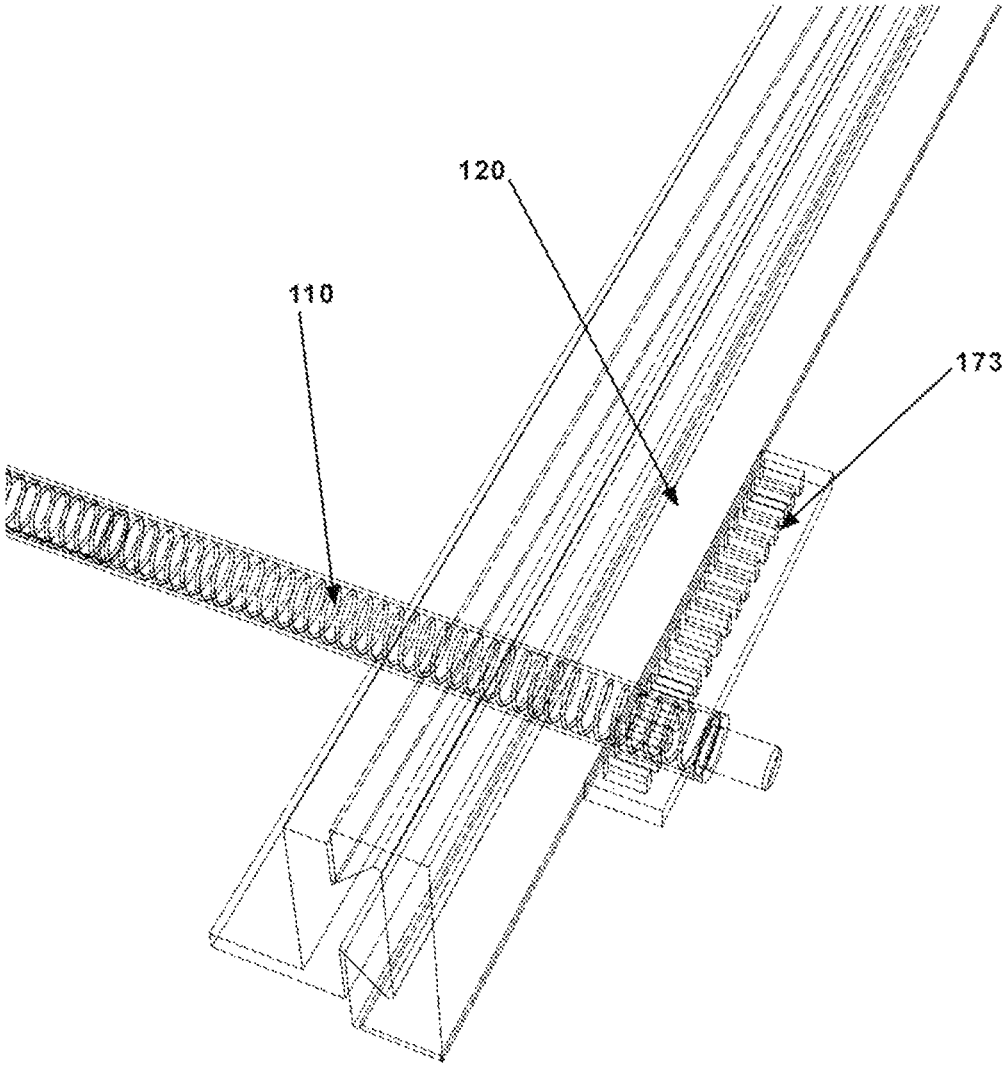
FIG. 3E is a top view of a drawer slide with a slotted mounting base.
Figure 3F:
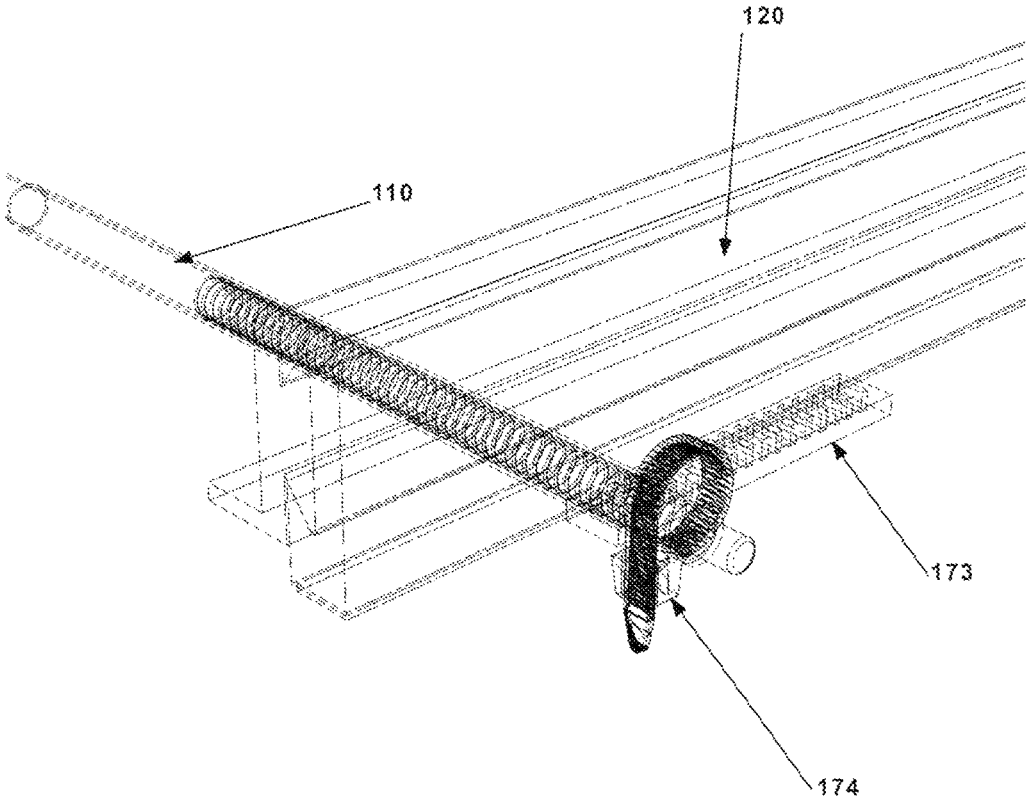
FIG. 3F is a perspective view of the drawing slide and mounting base of FIG. 3E secured with a zip tie.

It will be appreciated that the drawer slides 120 may be secured to the cross bars 110 using other means. For example, the drawer slides 120 (FIG. 3C) may be secured by brackets 171 (FIG. 3D) with screws 172 (FIG. 3D) securing the brackets 171 (FIG. 3C) under the cross bars 110 (FIG. 3C) or by tying straps, such as zip ties or the like, 174 (FIG. 3F) around the cross bars 110 (FIG. 3F) through a slotted mounting base 173 (FIG. 3F), which is attached permanently to drawer slide 120 (FIG. 3E). As with the latch/strike mechanism 150/160, such means also enable the drawer slides 120 to be easily removed from the cross bars 110.

Figure 5A:
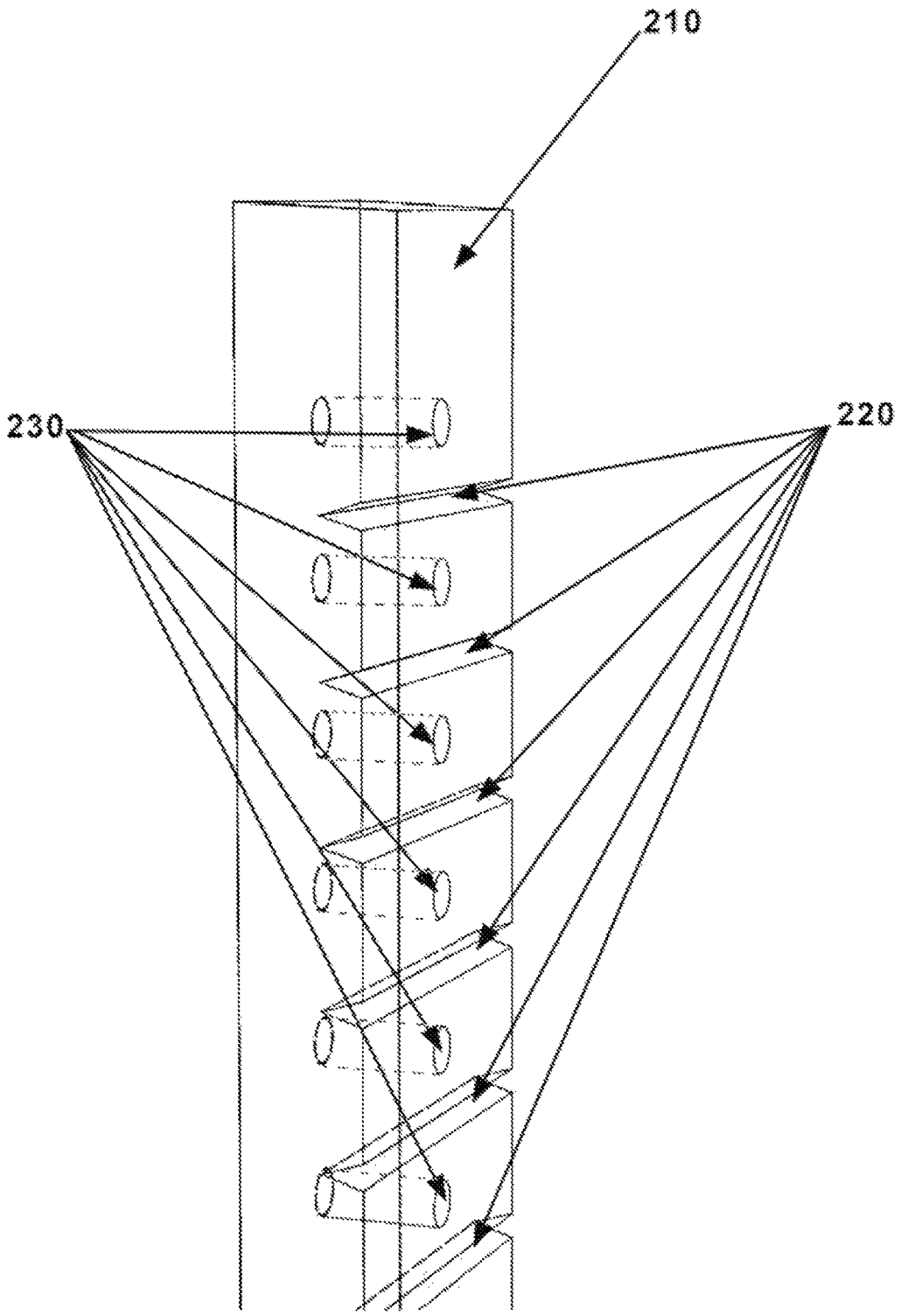
FIG. 5A is an isometric close-up view of a pre-scored shelf standard of the drawer slide system of FIG. 1A.
Figure 5B:
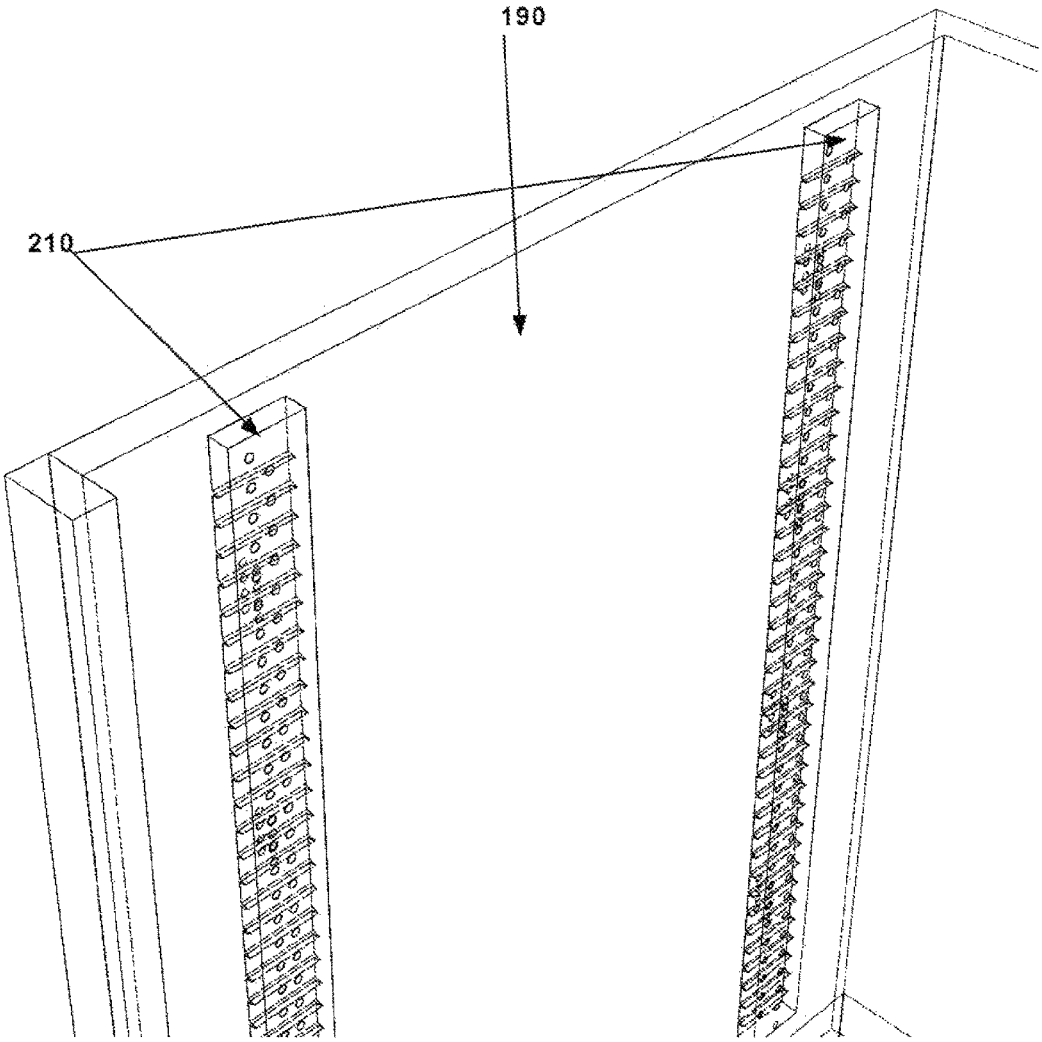
FIG. 5B is an isometric close-up view of the pre-scored shelf standard of FIG. 5A installed inside the cabinet.

FIG. 5A illustrates vertical shelf standards 210 with pre-scored with horizontal lines 220 between vertically spaced apart holes 230 for shelf pins. The pre-scored shelf standards 210 are optional and are made of a rigid material that can be attached to the inside wall of the cabinet 190 if pre-drilled holes 200 are not available. The pre-scored lines 220 are optional and allow a user to easily breakaway a section of the shelf standard 210 in straight line at a length that will fit inside the cabinet 190. FIG. 5B shows two shelf standards 210 installed on one of the inside walls of the cabinet 190. The shelf standards 210 are preferably secured with the pre-scored lines 220 facing the cabinet wall for better structural support since side of the shelf standard 210 with the pre-scored lines 220 is less rigid than the other side. Once the shelf standards 210 are secured to the inside walls of the cabinet 190, the user can easily install the cross bars 110 (FIG. 1A) into the shelf pin holes 230 at the desired height on the shelf standards 210.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A drawer slide system, comprising:

a front cross bar, comprising a right end configured to fit into a first opening in a right inside surface at a front of a cabinet and a left end configured to fit into a second opening opposite the first opening in a left inside surface at the front of the cabinet;

a rear cross bar, comprising a right end configured to fit into a third opening in the right inside surface at a rear of the cabinet and a left end configured to fit into a fourth opening opposite the third opening in the left inside surface at the rear of the cabinet; and right and left drawer slides, each comprising:

a slide bracket extending from a bottom of each drawer slide and configured to be secured to one side of a drawer;

a removable lower clamp jaw having a latch extending upward from a front section;

a support extending downward from a rear of each drawer slide, the support having a lower slot configured to receive a back end of the lower clamp jaw; and a strike located at a front section of each drawer slide and configured to receive the latch and clamp onto the front cross bar.

2. The drawer slide system of claim 1, wherein the front and rear cross bars are spring loaded, each cross bar comprising a first piece biased against a second piece.

3. The drawer slide system of claim 1, wherein the front and rear cross bars are extendable.

4. The drawer slide system of claim 3, wherein the front and rear cross bars each comprise a first piece threaded into a second piece whereby partially unscrewing the first and second pieces extends the cross bar.

5. The drawer slide system of claim 3, wherein the front and rear cross bars each comprise a first piece telescoping into a second piece.

6. A drawer slide system, comprising:

a front cross bar, comprising a right end configured to fit into a first opening in a right inside surface at a front of a cabinet and a left end configured to fit into a second opening opposite the first opening in a left inside surface at the front of the cabinet;

a rear cross bar, comprising a right end configured to fit into a third opening in the right inside surface at a rear of the cabinet and a left end configured to fit into a fourth opening opposite the third opening in the left inside surface at the rear of the cabinet;

right and left drawer slides, each comprising a slide bracket extending from a bottom of each drawer slide and configured to be secured to one side of a drawer; and means for securing each drawer slide to the cross bars, comprising:

a removable lower clamp jaw having a latch extending upward from a front section;

a support extending downward from a rear of each drawer slide, the support having a lower slot configured to receive a back end of the lower clamp jaw;

a strike located at a front section of each drawer slide and configured to receive the latch and clamp onto the front cross bar.

7. The drawer slide system of claim 6, wherein:

the right inside surface at the front of the cabinet and the right inside surface at the rear of the cabinet comprise a right inside surface of the cabinet; and the left inside surface at the front of the cabinet and the left inside surface at the rear of the cabinet comprise a left inside surface of the cabinet.

8. The drawer slide system of claim 6, wherein:

the right inside surface at the front of the cabinet comprises a first vertical shelf standard;

the right inside surface at the rear of the cabinet comprises a second vertical shelf standard;

the left inside surface at the front of the cabinet comprise a third vertical shelf standard; and the left inside surface at the front of the cabinet comprise a fourth vertical shelf standard;

wherein:

the first shelf standard has a plurality of vertically spaced apart openings, including the first opening, formed in the right inside surface at the front of the cabinet;

the second shelf standard has a plurality of vertically spaced apart openings, including the second opening, formed in the right inside surface at the rear of the cabinet;

the third shelf standard has a plurality of vertically spaced apart openings, including the third opening, formed in the right inside surface at the front of the cabinet; and the fourth shelf standard has a plurality of vertically spaced apart openings, including the fourth opening, formed in the right inside surface at the rear of the cabinet.

9. The drawer slide system of claim 8, wherein each of the first, second, third and fourth shelf standards further has a horizontal score line between each adjacent opening.

10. The drawer slide system of claim 6, wherein the front and rear cross bars are spring loaded, each cross bar comprising a first piece biased against a second piece.

11. The drawer slide system of claim 6, wherein the front and rear cross bars are extendable.

12. A drawer slide system, comprising:

a front cross bar, comprising a right end configured to fit into a first opening in a right inside surface at a front of a cabinet and a left end configured to fit into a second opening opposite the first opening in a left inside surface at the front of the cabinet;

a rear cross bar, comprising a right end configured to fit into a third opening in the right inside surface at a rear of the cabinet and a left end configured to fit into a fourth opening opposite the third opening in the left inside surface at the rear of the cabinet;

right and left drawer slides, each comprising a slide bracket extending from a bottom of each drawer slide and configured to be secured to one side of a drawer;

wherein:

the right inside surface at the front of the cabinet comprises a first vertical shelf standard;

the right inside surface at the rear of the cabinet comprises a second vertical shelf standard;

the left inside surface at the front of the cabinet comprise a third vertical shelf standard; and the left inside surface at the front of the cabinet comprise a fourth vertical shelf standard;

wherein further:

the first shelf standard has a plurality of vertically spaced apart openings, including the first opening, formed in the right inside surface at the front of the cabinet;

the second shelf standard has a plurality of vertically spaced apart openings, including the second opening, formed in the right inside surface at the rear of the cabinet;

the third shelf standard has a plurality of vertically spaced apart openings, including the third opening, formed in the right inside surface at the front of the cabinet; and the fourth shelf standard has a plurality of vertically spaced apart openings, including the fourth opening, formed in the right inside surface at the rear of the cabinet; and means for securing each drawer slide to the cross bars.

13. The drawer slide system of claim 12, wherein each of the first, second, third and fourth shelf standards further has a horizontal score line between each adjacent opening.

* * * * *